US009703238B2

(12) United States Patent
Izumiya et al.

(10) Patent No.: US 9,703,238 B2
(45) Date of Patent: Jul. 11, 2017

(54) IMAGE FORMING SYSTEM

(71) Applicant: Konica Minolta, Inc., Tokyo (JP)

(72) Inventors: Kenji Izumiya, Hachioji (JP); Kiyoto Kojima, Hachioji (JP); Satoshi Ogata, Hachioji (JP); Hirokatsu Kodama, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/016,849

(22) Filed: Feb. 5, 2016

(65) Prior Publication Data

US 2016/0259278 A1 Sep. 8, 2016

(30) Foreign Application Priority Data

Mar. 2, 2015 (JP) ..... 2015-039821

(51) Int. Cl.
*G03G 15/00* (2006.01)
*G03G 15/20* (2006.01)

(52) U.S. Cl.
CPC ..... *G03G 15/2028* (2013.01); *G03G 15/2039* (2013.01); *G03G 15/6538* (2013.01); *G03G 15/6588* (2013.01); *G03G 15/6591* (2013.01)

(58) Field of Classification Search
CPC ..... G03G 15/6538; G03G 15/6547; G03G 15/6552; G03G 2215/00421;
(Continued)

(56) References Cited

U.S. PATENT DOCUMENTS 5,136,343 A * 8/1992 Braswell ..... G03G 15/6538 271/287
5,177,546 A * 1/1993 Tsubo ..... G03G 15/6538 270/58.18
(Continued)

FOREIGN PATENT DOCUMENTS

JP 2003280461 A * 10/2003
JP 2005-189780 A 7/2005
(Continued)

OTHER PUBLICATIONS

Notice of Reasons for Rejection dated Feb. 28, 2017 from corresponding Japanese Patent Application No. JP 2015-039821; English translation of Notice of Reasons for Rejection; Total of 17 pages.

*Primary Examiner* — Francis Gray
(74) *Attorney, Agent, or Firm* — Lucas & Mercanti, LLP

(57) ABSTRACT

An image forming system includes: an image forming apparatus that forms an image on a sheet; one or more sheet carrying devices successively disposed on the downstream side of the image forming apparatus; and a control device that controls the image forming apparatus and the one or more sheet carrying devices based on a job that designates a page configuration containing a page order and sheet types, wherein the sheet carrying device includes a bypass conveyance path along which the sheet output from an upstream device is conveyed toward a downstream device, and a sheet tray unit that temporarily stores the sheet output from the upstream device and discharges the sheet toward the bypass conveyance path, and the control device divides the job into sheet types and determines a printing order of the divided sheet types and sheet types to be stored in the sheet carrying device.

13 Claims, 6 Drawing Sheets

(58) Field of Classification Search
CPC ..... G03G 2215/0089; G03G 15/2028; G03G 15/2039; G03G 15/6588; G03G 15/6591; B65H 2801/27; B65H 2301/161
USPC ..... 399/82
See application file for complete search history.

(56) References Cited

U.S. PATENT DOCUMENTS 5,182,607 A * 1/1993 Braswell ..... G03G 15/6538 271/290
6,351,625 B1 * 2/2002 Sato ..... G03G 15/655 399/382
6,370,343 B1 * 4/2002 Watanabe ..... G03G 15/0131 358/300
2001/0055123 A1 * 12/2001 Ryan ..... G06Q 10/06 358/1.12
2003/0168796 A1 * 9/2003 Suzuki ..... B42C 19/08 270/58.07
2004/0028420 A1 * 2/2004 Aslam ..... G03G 15/2064 399/45
2006/0055766 A1 * 3/2006 Kawata ..... G03G 15/50 347/164
2008/0018915 A1 * 1/2008 Moore ..... B65H 7/00 358/1.1
2008/0075490 A1 * 3/2008 Ota ..... G03G 15/2064 399/45
2008/0079980 A1 * 4/2008 Matsubara ..... B41J 13/0009 358/1.14
2008/0229940 A1 * 9/2008 Levin ..... B41J 11/006 101/2
2008/0277866 A1 * 11/2008 Moriyama ..... B65H 39/10 271/279
2010/0189450 A1 * 7/2010 Hosoda ..... G03G 15/2039 399/45
2012/0148274 A1 * 6/2012 Pickering ..... G03G 15/657 399/45
2013/0321863 A1 * 12/2013 Fukuda ..... B65H 3/44 358/1.15
2015/0355589 A1 * 12/2015 Miyajima ..... G03G 15/5091 399/82
2016/0170692 A1 * 6/2016 Osada ..... H04N 1/0057 358/1.15

FOREIGN PATENT DOCUMENTS

JP 2009-020176 A 1/2009
JP 2009-063818 A 3/2009
JP 2011073246 A 4/2011
JP 2013-057922 A 3/2013

* cited by examiner

IMAGE FORMING SYSTEM

The entire disclosure of Japanese Patent Application No. 2015-039821 filed on Mar. 2, 2015 including description, claims, drawings, and abstract are incorporated herein by reference in its entirety.

BACKGROUND OF THE INVENTION

Field of the Invention

The present invention relates to an image forming system.

Description of the Related Art

An image forming apparatus using an electrophotographic system is known. The image forming apparatus of this type forms an image on a sheet by executing a series of processes such as image transfer and image fixation. With increasing variations of needs from users, there is a demand for such an image forming apparatus capable of handling a job designating a different sheet type for particular pages in a series of pages, as well as a job designating the same sheet type for the respective pages constituting the job.

A fixing control temperature set for an image forming apparatus varies according to a paper type (sheet type). Accordingly, a setting value of the fixing control temperature needs to vary in accordance with switching of the sheet type at the time of execution of a job handling a mixture of plural sheet types. Switching of the fixing control temperature requires a certain period of time, and thus increases a processing time for executing one job. The productivity tends to lower as the processing time increases.

A possible solution to this problem is to unify respective sheets into groups of sheet types each having the same fixing control temperature, and perform printing for each sheet type. In this case, a switching frequency of the fixing control temperature decreases in comparison with printing performed in the page order. Accordingly, productivity is expected to improve.

For example, JP 2003-280461 A discloses an image forming apparatus which unifies respective sheets into groups of sheet types, and outputs the respective sheet types in the ascending order of the fixing control temperature when different sheet types are designated for a plurality of images formed on sheets.

On the other hand, JP 2011-73246 A discloses a printing device. More specifically, the printing device temporarily determines the printing order such that printing starts in the descending order of drying time for images with reference to a printing table created in response to a printing instruction designating a plurality of images and a discharge order of these images. The printing device allocates the respective images to four drying stages such that the difference in the sum of the drying time becomes the minimum between the respective drying stages. The printing device sorts the temporarily determined printing order such that the front-rear relationship between the images allocated to each drying stage becomes identical to the front-rear relationship of the discharge order to determine the printing order. The printing device prints images in accordance with the determined printing order, distributes the printed sheets to the respective drying stages, and discharges the distributed sheets from the respective drying stages in accordance with the discharge order.

When printing is performed for each sheet type, however, the output order changes from the page order designated by the job. Accordingly, there is a necessity for executing a process for inserting the earlier printed sheet type between pages of the subsequently printed sheet type to arrange the respective sheets in the designated page order. This process is considerably complicated particularly when the process is manually executed. The complication of the process becomes more remarkable as the number of pages and the number of copies increase. Furthermore, in case of a series of devices (image forming system) constituted by an image forming apparatus and devices provided downstream, this process requires sufficient consideration about elements, such as a page configuration of a job and configurations of the downstream devices, as elements conceivable in various possible modes. When sufficient consideration is not made, work efficiency and productivity may lower.

SUMMARY OF THE INVENTION

The present invention has been developed in consideration of the aforementioned problems. It is an object of the present invention to provide an image forming system capable of producing final printings arranged in a page order of a job with high work efficiency and productivity even when printing is performed in an order different from the page order.

To achieve the abovementioned object, according to an aspect, an image forming system reflecting one aspect of the present invention comprises: an image forming apparatus that forms an image on a sheet; one or more sheet carrying devices successively disposed on the downstream side of the image forming apparatus; and a control device that controls the image forming apparatus and the one or more sheet carrying devices based on a job that designates a page configuration containing a page order and sheet types of respective pages. Each of the sheet carrying devices includes a bypass conveyance path along which the sheet output from an upstream device is conveyed toward a downstream device, and a sheet tray unit that temporarily stores the sheet output from the upstream device and discharges the stored sheet toward the bypass conveyance path. The control device divides the job into sheet types based on a division condition determined beforehand, and the number of the sheet carrying device or devices disposed on the downstream side of the image forming apparatus, and determines a printing order of the divided sheet types and sheet type or types to be stored in the sheet carrying device or devices.

According to this aspect of the present invention, the division condition is preferably a fixing control temperature for fixing a transferred image to the sheet by the image forming apparatus.

According to this aspect of the present invention, the division condition preferably further includes the page configuration of the job.

According to this aspect of the present invention, the control device preferably unifies sheet types each containing a smaller number of pages to reconstruct divisions when the number of the divided sheet types is larger than the number of the sheet carrying device or devices.

According to this aspect of the present invention, the control device preferably unifies sheet types of sheets requiring close fixing control temperatures to reconstruct divisions when the number of the divided sheet types is larger than the number of the sheet carrying device or devices.

According to this aspect of the present invention, the control device preferably allows printing for the sheet types in the ascending order of the number of pages contained in each of the sheet types, stores the sheet type or types in the sheet carrying device or devices, and draws the sheets stored in the sheet carrying device or devices in accordance with printing for the final sheet type to arrange the respective sheets in the page order at the time of discharge.

According to this aspect of the present invention, the control device preferably reverses the page order for the sheet types for which printing is performed earlier, and allows printing in the page order for the sheet type for which printing is finally performed.

According to this aspect of the present invention, the control device preferably compares the sum of a sheet insertion time of the sheet carrying device associated with one sheet type and a fixing control temperature switch time of the image forming apparatus associated with the one sheet type, with a printing time of the image forming apparatus associated with a different sheet type to determine a printing order of the one sheet type and the different sheet type.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

First Embodiment

Figure 1:
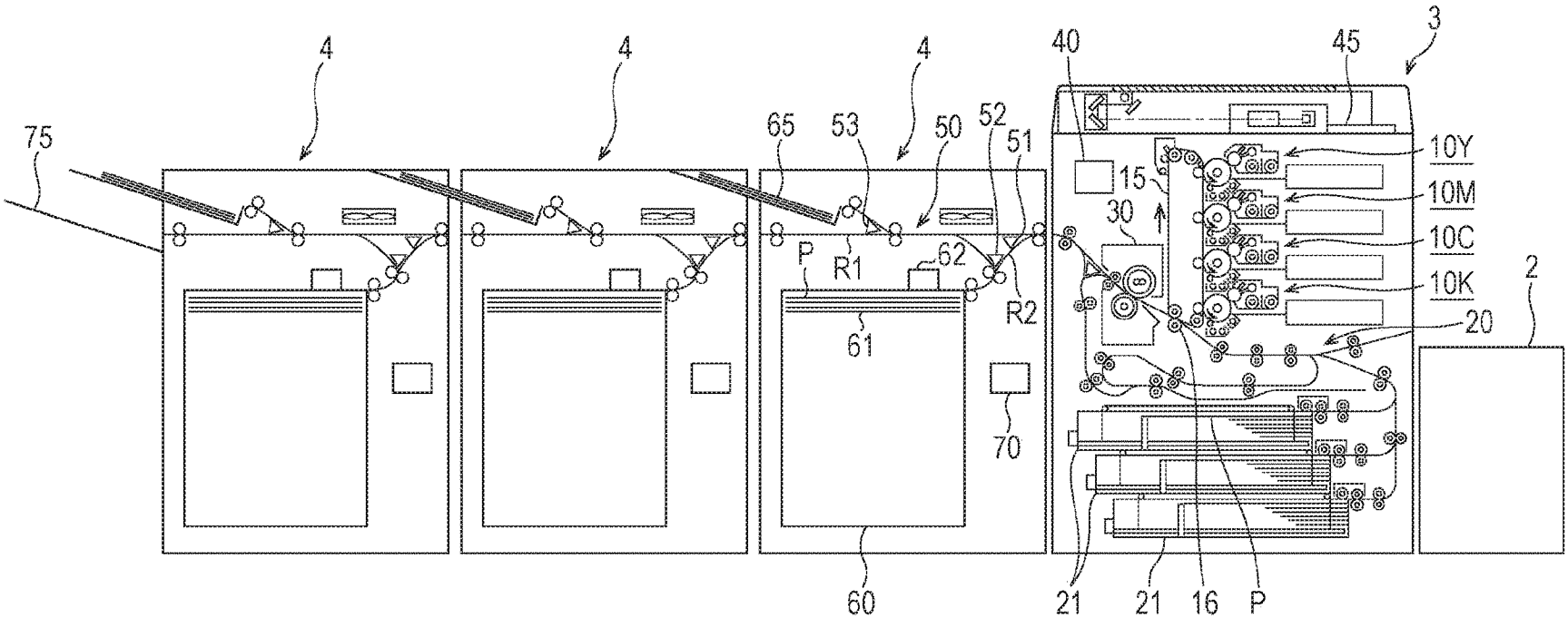
FIG. 1 is an explanatory view schematically illustrating a configuration of an image forming system according to a first embodiment.

FIG. 1 is an explanatory view schematically illustrating an image forming system 1 according to a first embodiment. The image forming system 1 includes a print controller 2, an image forming apparatus 3, and three sheet carrying devices 4.

The print controller 2 receives PDL (Page Description Language) data corresponding to a job from a computer terminal provided on a network, rasterizes the PDL data, and generates image data in bitmap format. The print controller 2 generates image data in respective colors of C (cyan), M (magenta), Y (yellow), and K (black), and outputs the generated image data to the image forming apparatus 3.

The image forming apparatus 3 is an electrophotographic image forming apparatus, for example. The image forming apparatus 3 functions as a so-called tandem-type color image forming apparatus including a plurality of photosensitive drums. The photosensitive drums are arranged in the longitudinal direction of the apparatus at positions facing a single intermediate transfer belt to form full color images. The image forming apparatus 3 is chiefly constituted by a document reading device SC, four image forming units 10Y, 10M, 10C, and 10K, a fixing device 30, and a control unit 40.

The document reading device SC applies light to an image of a document by using an optical system of an illumination device, and reads reflection light by using a line image sensor to obtain an image signal. This image signal is input to the control unit 40.

The four image forming units 10Y, 10M, 10C, and 10K are provided as a set of units constituted by the image forming unit 10Y for forming images in yellow (Y), the image forming unit 10M for forming images in magenta (M), the image forming unit 10C for forming images in cyan (C), and the image forming unit 10K for forming images in black (K). Each of the image forming units 10Y, 10M, 10C, and 10K is constituted by a photosensitive drum, and a charging unit, an optical writing unit, a developing device, and a drum cleaner disposed around the photosensitive drum.

The surface of the photosensitive drum is uniformly charged by the charging unit. A latent image is formed on the photosensitive drum by scan and exposure performed by the optical writing unit. The developing device develops the latent image formed on the photosensitive drum with toner to visualize the latent image. As a result, an image (toner image) in a predetermined color corresponding to any one of yellow, magenta, cyan, and black is formed on the photosensitive drum. The image formed on the photosensitive drum is sequentially transferred by a primary transfer roller to a predetermined position on a rotating intermediate transfer belt 15.

The image transferred to the intermediate transfer belt 15 is further transferred by a secondary transfer roller 16 to a sheet P conveyed by a sheet conveyance unit 20 (detailed below) at predetermined timing. The secondary transfer roller 16 is pressed against the intermediate transfer belt 15 to form a transfer nip at the pressed portion.

The sheet conveyance unit 20 receives the sheets P fed from sheet feed units 21, and conveys the sheets P along a conveyance path. The three sheet feed units 21 are provided, for example, so that different types of the sheets P can be set for the respective sheet feed units 21. The sheets P on each of the sheet feed units 21 are carried on a sheet tray. The sheets P carried on the sheet tray are drawn by a sheet feed roller, and delivered to the conveyance path. A plurality of conveyance means are provided along the conveyance path for conveying the sheets P. Each of the conveyance means is constituted by a pair of rollers pressed against each other.

The fixing device 30 is a device for performing a fixing process for the sheet P to which an image has been transferred. For example, the fixing device 30 is constituted by a pair of fixing rollers pressed against each other and forming a fixing nip, and a heater for heating one or both of these fixing members. The fixing device 30 fixes the transferred image to the sheet P through effects of pressure given by the pair of the fixing rollers, and heat retained by the fixing rollers. The sheet P subjected to the fixing process of the fixing device 30 is discharged by a discharge roller to the outside of the device.

An operation panel 45 is a touch panel type input unit capable of receiving information input in accordance with information displayed on a display. A user inputs information such as a job setting and a processing change by operating the operation panel 45. The information input to the operation panel 45 is acquired by the control unit 40. The operation panel 45 also functions as a display unit for displaying various types of information under control by the control unit 40 to present various pieces of information to the user through the operation panel 45.

The control unit 40 provided for controlling the image forming apparatus 3 may be constituted by a microcomputer chiefly including a CPU, a ROM, a RAM, and an I/O interface. The control unit 40 allows the image forming units 10Y, 10M, 10C, and 10K to form images on a sheet based on image data output from the print controller 2 in accordance with a setting of a job. For example, the control unit 40 controls a fixing control temperature, i.e., a temperature of the fixing process executed by the fixing device 30.

The control unit 40 also functions as a control device for controlling the image forming system 1 in an integrated manner, as well as for controlling the image forming apparatus 3. The control unit 40 is configured to communicate with the respective sheet carrying devices 4. The control unit 40 outputs control signals to the respective sheet carrying devices 4 to allow the sheet carrying devices 4 to operate at the output timing of the sheets P from the image forming apparatus 3.

The sheet carrying devices 4 are disposed on the downstream side of the image forming apparatus 3. According to this embodiment, the three sheet carrying devices 4 are successively arranged. Each of the sheet carrying devices 4 receives the sheet P output from the image forming apparatus 3, and conveys the sheet P to downstream devices. Each of the sheet carrying devices 4 is configured to either convey the received sheet P to the downstream devices, or temporarily accumulate the received sheet P, feed the accumulated sheet P at appropriate timing, and convey the sheet P toward the downstream devices. In the latter case, the accumulated sheet P may be inserted between the subsequent sheets P output from the image forming apparatus 3 in accordance with the feed timing of the accumulated sheet P.

Each of the sheet carrying devices 4 is chiefly constituted by a sheet conveyance unit 50, a sheet tray unit 60, a sheet discharge unit 65, and a control unit 70.

The sheet conveyance unit 50 receives the sheet P supplied from upstream devices, and conveys the sheet P along predetermined conveyance paths R1 and R2. The sheet conveyance unit 50 is chiefly constituted by a guide plate disposed along the conveyance paths R1 and R2, and a plurality of conveyance rollers. A plurality of switching gates 51, 52, and 53 are provided on the conveyance paths.

The first switching gate 51 is a gate which switches the route for conveying the sheet P between a route toward the downstream side along the conveyance path R1 corresponding to a bypass path (hereinafter referred to as "bypass conveyance path"), and a route toward the conveyance path R2 for reaching the sheet tray unit 60 (hereinafter referred to as "tray conveyance path"), after the sheet P is supplied into the device. The second switching gate 52 is a gate which switches the direction of the sheet P delivered from the sheet tray unit 60 to join the sheet P to a predetermined downstream position of the bypass conveyance path R1. The third switching gate 53 is a gate disposed on the bypass conveyance path R1 on the downstream side with respect to the junction position of the sheet P delivered from the sheet tray unit 60. The third switching gate 53 switches the route of the conveyed sheet P between a route along the bypass conveyance path R1 toward the outside of the device, and a route toward the sheet discharge unit 65.

The sheet tray unit 60 is constituted by a sheet tray 61 for carrying the sheets P, a feed unit 62 for delivering the sheet P placed on the uppermost surface of a bundle of sheets carried on the sheet tray 61 toward the tray conveyance path R2. The sheet tray unit 60 has a function of temporarily carrying the sheet P supplied into the device, and a function of feeding and joining the carried sheet P to the bypass conveyance path R1, for example.

The sheet discharge unit 65 is a unit for discharging the sheet P stored in the sheet tray unit 60. The sheet discharge unit 65 is a tray for purging the sheet P remaining as a result of jamming, for example. The sheet discharge unit 65 therefore has a function of processing the remaining sheet P without discharging the sheet P to a discharge tray 75. Accordingly, the sheet discharge unit 65 prevents a change of the page order of the sheets P discharged to the discharge tray 75.

The control unit 70 provided for controlling the sheet carrying devices 4 may be constituted by a microcomputer chiefly including a CPU, a ROM, a RAM, and an I/O interface. The control unit 70 controls operation of the sheet carrying devices 4 in accordance with control signals generated from the control unit 40 of the image forming apparatus 3.

More specifically, each of the sheet carrying devices 4 is configured to either convey the sheet P received from the upstream devices toward the downstream devices, or temporarily accumulate the received sheet P in the sheet tray unit 60, feed the accumulated sheet P at appropriate timing, and convey the accumulated sheet P toward the downstream devices. Each of the sheet carrying devices 4 is capable of inserting the accumulated sheet P between subsequent sheets output from the image forming apparatus 3 in accordance with feed timing of the accumulated sheet P.

The discharge tray 75 is provided on the sheet carrying device 4 disposed on the most downstream side in the three sheet carrying devices 4. The sheet P discharged from the sheet carrying device 4 on the most downstream side is carried on the discharge tray 75.

Described hereinafter is output operation performed by the image forming system 1 for outputting the sheet P according to this embodiment. The output operation for outputting the sheet P is chiefly performed by the control unit 40 of the image forming apparatus 3 corresponding to a control device for controlling the image forming system 1 in an integrated manner.

Before detailing the output operation performed by the image forming system 1 for outputting the sheet P, a concept of this operation is initially explained. It is assumed in this explanation that a job is constituted by sort output of 100 copies of printings. Each of the copies includes six pages in total arranged in a certain page order. The job designates the page order, and a sheet type for each page. FIGS. 2A through 2C and FIGS. 3A through 3C are explanatory views illustrating the concept of the output operation for outputting the sheet P. In these figures, "Pa" indicates each page of the printings. A page number of each page is shown within a corresponding rectangular frame.

Initially, the control unit 40 refers to a page configuration designated in the job, and divides respective pages constituting the job into groups of sheet types. This division process is executed under a division condition. More specifically, based on the fixing control temperature as the division condition, sheet types corresponding to an identical fixing control temperature are unified into one group. The fixing control temperature is set beforehand for each sheet type. The control unit 40 retains a table indicating a correlation between sheet types and fixing control temperatures.

According to the examples illustrated in FIGS. 2A through 2C and FIGS. 3A through 3C, a hatched 1 page Pa is grouped into a sheet type corresponding to a fixing control temperature of 180° C. On the other hand, 2 through 5 pages Pa are grouped into a sheet type corresponding to a fixing control temperature of 200° C., and a 6 page Pa is grouped into a sheet type corresponding to a fixing control temperature of 190° C. According to these examples, respective sheets are divided into three sheet types (sheet type groups) of a sheet type containing the 1 page Pa, a sheet type containing the 2 through 5 pages Pa, and a sheet type containing the 6 page Pa.

Then, the control unit 40 compares the number of divisions and the number of the sheet carrying devices 4 included in the image forming system 1, and determines the printing order of the respective divided sheet types, and the sheet types to be carried on the respective sheet carrying devices 4.

More specifically, the control unit 40 determines whether or not the division number is larger than the sum of 1 and the number of the sheet carrying devices 4. In the case that the number of divisions of sheet types is three, and that the number of the sheet carrying devices 4 is three as illustrated in FIG. 1, the number of divisions of sheet types is smaller than the sum of 1 and the number of the sheet carrying devices 4. In this case, the printing order is determined such that the sheet type containing a smaller number of pages is printed earlier than the other sheet types. When the sheet type containing a larger number of pages is printed earlier, a time is required for insertion of the sheet type containing the larger number of pages by the corresponding sheet carrying device 4. In this case, the image forming apparatus 3 discharges the subsequent sheets P with a delay of the insertion time, thereby lowering productivity. According to the example illustrated in FIG. 2B, printing is initially performed for 100 copies of a sheet type A containing the 1 page Pa. Then, printing is performed for 100 copies of a sheet type B containing 6 page Pa, and finally for 100 copies of a sheet type C containing the 2 through 5 pages Pa.

Concerning the sheet type A and the sheet type B printed earlier, the control unit 40 gives an instruction for storing the sheet type A and the sheet type B in the different sheet carrying devices 4, respectively, after completion of printing. For example, the sheet type A is stored in the sheet carrying device 4 positioned immediately downstream from the image forming apparatus 3, while the sheet type B is stored in the sheet carrying device 4 positioned immediately downstream from the sheet carrying device 4 for storing the sheet type A. However, the respective sheet types may be stored in any of the sheet carrying devices 4 as long as each of the sheet types is separately stored in the corresponding sheet carrying device 4.

Figure 2A:
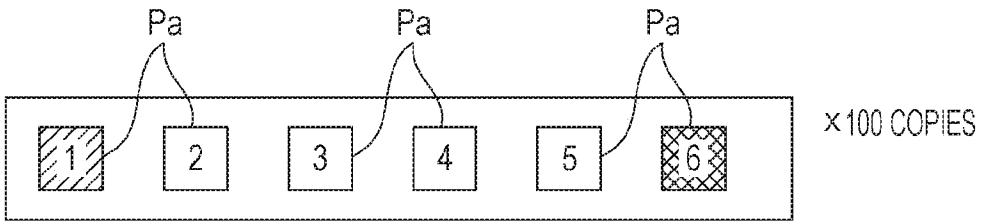
FIGS. 2A through 2C are explanatory views illustrating a concept of a sheet output operation.
Figure 2B:
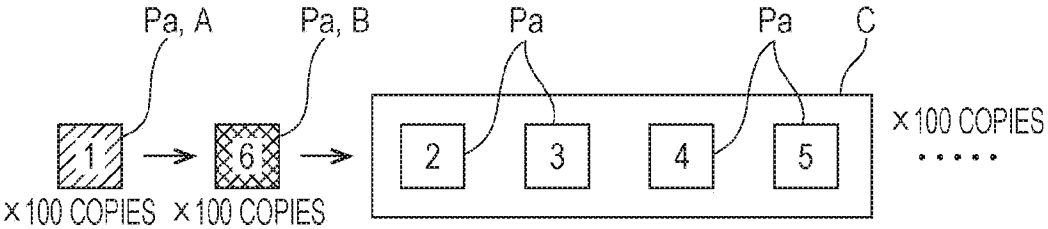
Figure 2C:
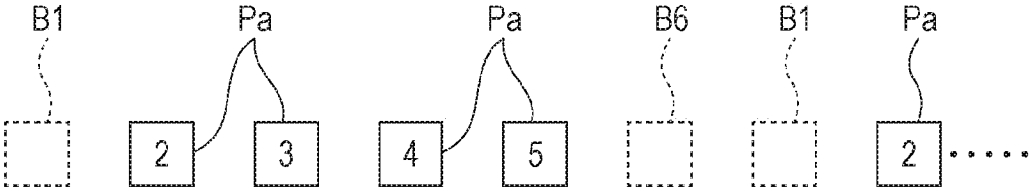

Finally, printing is performed for 100 copies of the sheet type C containing 2 through 5 pages Pa. During printing of the sheet type C, the image forming apparatus 3 controls output intervals of the sheets P such that both an interval B1 for insertion of the sheet type A (1 page Pa) printed earlier, and an interval B6 for insertion of the sheet type B (6 page Pa) printed earlier can be secured (FIG. 2C).

After printing of the final sheet type C, each of the sheet carrying devices 4 conveys the sheets P of the 2 through 5 pages Pa along the bypass conveyance path R1 toward the discharge tray 75 while bypassing the corresponding sheet tray unit 60. The sheet carrying device 4 storing the 1 page Pa (sheet type A) inserts the 1 page Pa before the 2 page Pa. Similarly, the sheet carrying device 4 storing the 6 page Pa (sheet type B) inserts the 6 page Pa after the 5 page Pa. As a result, printings arranged in the page order are stacked on the discharge tray 75 for each bundle of copies.

Figure 3A:
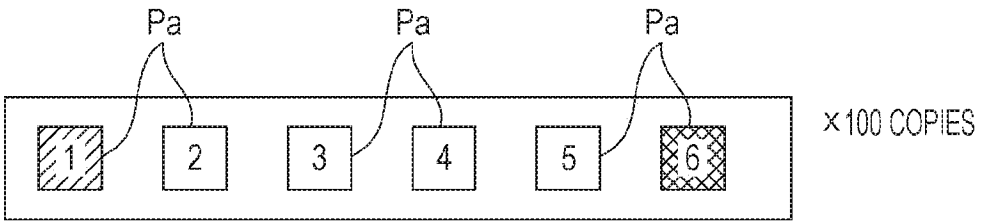
FIGS. 3A through 3C are explanatory views illustrating the concept of the sheet output operation.
Figure 3B:
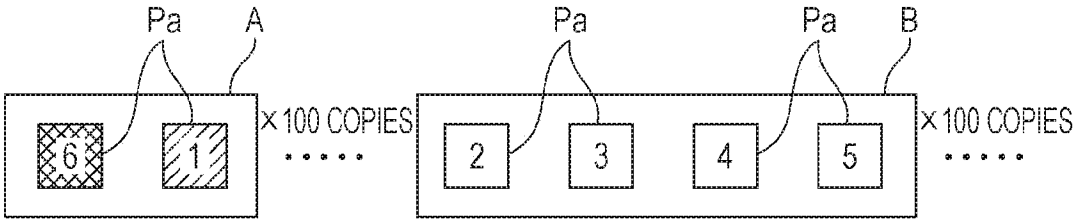
Figure 3C:
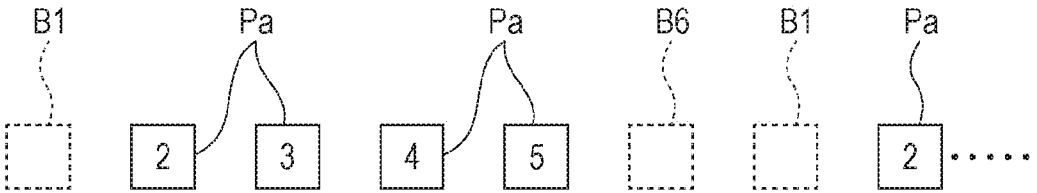

On the other hand, in the case that the number of divided sheet types is 3, and that only the single sheet carrying device 4 is provided, for example, the number of divisions is larger than the sum of 1 and the number of the sheet carrying device 4. In this case, the control unit 40 adds the page configuration of the job to the division condition to reconstruct the sheet type groups. For this reconstruction, the page configuration of the job is further considered as one of the division conditions. The page configuration corresponding to the division condition defines the number of pages for an identical sheet type. The control unit 40 unifies the sheet types in the ascending order of the number of pages to reconstruct the sheet type groups such that the number of divisions becomes equal to or smaller than the foregoing sum (number of sheet carrying device 4+1). As a result, a sheet type unifying the 1 page Pa and the 6 page Pa is produced as the new sheet type A as illustrated in FIG. 3B, whereby the respective sheets are divided into two sheet types of the new sheet type A, and the sheet type B containing the remaining 2 through 5 pages Pa.

After completion of the reconstruction of the sheet type groups, the control unit 40 determines the printing order such that printing is performed earlier for the sheet type containing a smaller number of pages. When printing is performed earlier for the sheet type containing a larger number of pages, a longer interval is required for insertion of the sheets P by the corresponding sheet carrying device 4. In this case, productivity of the image forming apparatus 3 lowers. According to the example illustrated in FIG. 3B, printing is initially performed for 100 copies of the sheet type A containing the 1 page Pa and 6 page Pa. Then, printing is performed for 100 copies of the sheet type B containing the 2 through 5 pages Pa.

During printing of the sheet type A, the control unit 40 reverses the page order. The control unit 40 also gives an instruction for storing the sheet type A subjected to early printing in the corresponding sheet carrying device 4.

Then, the control unit 40 performs printing for 100 copies of the sheet type C containing the 2 through 5 pages Pa. During printing of the sheet type C, the image forming apparatus 3 controls output intervals of the sheets P such that both an interval B1 for insertion of the sheet type A (1 page Pa) printed earlier, and an interval B6 for insertion of the sheet type B (6 page Pa) printed earlier can be secured (FIG. 2C).

After completion of the final sheet type C, each of the sheet carrying devices 4 conveys the 2 through 5 pages Pa along the bypass conveyance path toward the discharge tray 75 without storing the 2 through 5 pages Pain the corresponding sheet tray unit 60. The sheet carrying device 4 storing the 1 page Pa and 6 page Pa (sheet type A), which pages are arranged in the reverse order, sequentially inserts the 6 page Pa and the 1 page Pa after the 5 page Pa and before the 2 page. As a result, printings arranged in the page order are stacked on the discharge tray 75 for each bundle of copies.

Figure 4:
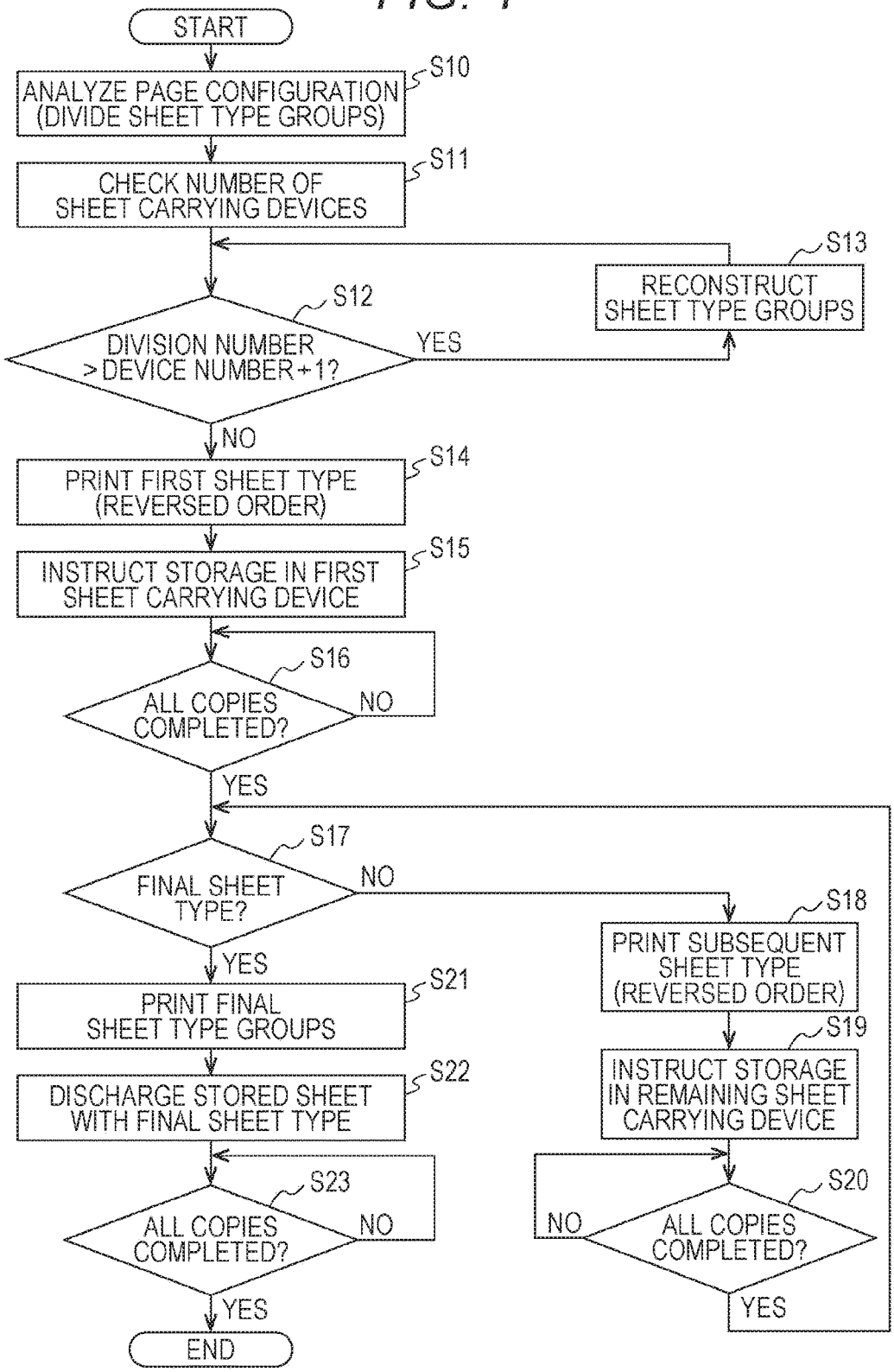
FIG. 4 is a flowchart illustrating output control performed by the image forming system for outputting sheets.

FIG. 4 is a flowchart illustrating output control performed by the image forming system 1 for outputting the sheet P. A process illustrated in this flowchart is executed by the control unit 40 in response to input of a job.

In step 10 (S10), the control unit 40 initially analyzes a page configuration of the job. More specifically, the control unit 40 divides pages into respective sheet types based on the fixing control temperature. In this case, pages corresponding to an identical fixing control temperature are unified into an identical sheet type. As a result, a plurality of sheet type divisions are produced.

In step 11 (S11), the control unit 40 checks the number of the sheet carrying devices 4.

In step 12 (S12), the control unit 40 determines whether or not the number of divisions is larger than the sum of 1 and the number of the sheet carrying devices 4. When "yes" in step 12, i.e., when the number of divisions is larger than the sum, the flow proceeds to step 13 (S13). When "No" in step 12, i.e., when the number of divisions is equal to or smaller than the sum, the flow proceeds to step 14 (S14).

In step 13, the control unit 40 adds a page configuration of the job to the division condition to reconstruct the sheet types. More specifically, the control unit 40 unifies the sheet types in the ascending order of the number of pages. This process in step 13 is repeated until the number of divisions of the sheet types becomes equal to or smaller than the sum (number of sheet carrying devices 4+1).

In step 14, the control unit 40 performs printing for a first sheet type printed earliest. In step 14, the first sheet type is selected from the plurality of sheet types such that printing is performed earliest for the sheet type containing the smallest number of pages. When a plurality of pages are contained in the first sheet type, the control unit 40 reverses the output order of the pages such that printing is performed in the descending order of the page number.

In step 15 (S15), the control unit 40 gives an instruction for storing the first sheet type in the first sheet carrying device 4. The first sheet carrying device 4 is selected beforehand from the three sheet carrying devices 4 included in the image forming system 1.

In step 16 (S16), the control unit 40 determines whether or not a process for copies of the first sheet type (printing and storage) has been completed. When it is determined that the process for copies of the first sheet type has been completed, the flow proceeds to step 17 (S17) based on "yes" in step 16. When it is determined that the process for copies of the first sheet type is not completed, the flow returns to step 16 based on "No" in step 16.

In step 17, the control unit 40 determines whether or not the sheet type for subsequent printing after the first sheet type is the final sheet type. When it is determined that the sheet type for subsequent printing is not the final sheet type, the flow proceeds to step 18 (S18) based on "No" in step 17. When it is determined that the sheet type for subsequent printing is the final sheet type, the flow proceeds to step 21 (S21) based on "Yes" in step 17.

In step 18, the control unit 40 selects the sheet type containing a smaller number of pages from the subsequent sheet types, i.e., the remaining sheet types, and performs printing for the selected sheet type. When the sheet type containing the smaller number of pages contains a plurality of pages, the control unit 40 reverses the output order of the pages such that printing is performed in the descending page order.

In step 19 (S19), the control unit 40 gives an instruction for storing the subsequent sheet type in the remaining sheet carrying device 4 not storing the sheets P. The first sheet carrying device 4 for storing the subsequent sheet type is selected beforehand from the three sheet carrying devices 4 included in the image forming system 1.

In step 20 (S20), the control unit 40 determines whether or not a process for copies of the subsequent sheet type (printing and storage) has been completed. When it is determined that the process for copies of the corresponding sheet type has been completed, the flow returns to step 17 based on "Yes" in step 20. When it is determined that the process for copies of the corresponding sheet type is not completed, the flow returns to step 20 based on "No" in step 20.

In step 21, the control unit 40 performs printing for the final sheet type, i.e., the sheet type containing the largest number of pages in the divided sheet types. In this step, printing is performed in the output order of pages unlike steps 14 and 18. In addition, the output interval of the sheet P is controlled such that a sufficient space between the sheets can be secured for insertion of the earlier printed sheet type between the sheets.

In step 22 (S22), the control unit 40 outputs a control instruction to the sheet carrying device 4 storing the earlier printed sheet type to allow the corresponding sheet carrying device 4 to insert the stored sheet P in accordance with conveyance of the sheet P corresponding to the final sheet type. It is assumed herein that the subsequent sheet type corresponds to the 2 through 5 pages Pa, and that the sheet carrying device 4 stores the 6 page Pa and the 1 page Pa, for example. In this case, the sheet carrying device 4 sequentially inserts the 6 pages Pa and the 1 page Pa stored in the sheet tray unit 60 after the 5 page Pa and before the 2 page Pa while conveying the sheet P of the subsequent sheet type along the bypass conveyance path R1.

In step 23 (S23), the control unit 40 determines whether or not a process for copies of the final sheet type (printing and conveyance) has been completed. When it is determined that the process for copies of the final sheet type has been completed, the process of this flowchart ends based on "Yes" in step 22 (END). When it is determined that the process for copies of the final sheet type is not completed, the flow returns to step 22 based on "No" in step 22.

According to the embodiment described herein, the image forming system 1 includes: the image forming apparatus 3 that forms an image on the sheet P; the one or more sheet carrying devices 4 successively disposed on the downstream side of the image forming apparatus 3; and a control device that controls the image forming apparatus 3 and the one or more sheet carrying devices 4 based on a job that designates a page configuration containing a page order and sheet types of respective pages. Each of the sheet carrying devices 4 includes the bypass conveyance path R1 along which the sheet P output from an upstream device is conveyed toward a downstream device, and the sheet tray unit 60 that temporarily stores the sheet P output from the upstream device and discharges the stored sheet P toward the bypass conveyance path. According to this embodiment, the control device is realized by the control unit 40 included in the image forming apparatus 3.

The control unit 40 divides the job into sheet types based on a division condition determined beforehand, and the number of the sheet carrying device or devices 4 disposed on the downstream side of the image forming apparatus 3, and determines a printing order of the divided sheet types and sheet type or types to be stored in the sheet carrying device or devices 4.

According to this structure, the printing order of the respective sheet types, and the sheet types to be stored in the respective sheet carrying devices 4 are determined based on consideration of the page configuration of the job, and the configuration of the sheet carrying devices 4 connected to the image forming apparatus 3. In this case, both the image forming apparatus 3 and the sheet carrying devices 4 effectively operate to handle the job. Accordingly, production of final printings arranged in the page order is realizable with high work efficiency and productivity even when printing is performed in a page order different from the page order of the job.

According to this embodiment, the division condition is a fixing control temperature for fixing a transferred image to the sheet P by the image forming apparatus 3.

According to this structure, the respective pages are divided into the respective sheet types based on the fixing control temperature required for fixation by the image forming apparatus 3 for each sheet type at the time of determination of the printing order of the respective sheet types and others. In this case, printing is performed for each sheet type containing unified pages corresponding to an identical fixing control temperature, wherefore productivity improves in comparison with printing performed in the page order. Moreover, the printing order of the respective divided sheet types, and the sheet types to be stored in the sheet carrying devices 4 are appropriately determined. Accordingly, production of final printings arranged in the page order is realizable with high work efficiency and productivity.

According to this embodiment, the division condition further includes the page configuration of the job.

In this structure, division is made in consideration of not only the fixing control temperature but also the page configuration. Accordingly, division of pages is appropriately made in accordance with the device structure of the image forming system 1. Moreover, the printing order of the respective divided sheet types, and the sheet types to be stored in the sheet carrying devices 4 are appropriately determined. Accordingly, production of final printings arranged in the page order is realizable with high work efficiency and productivity.

According to this embodiment, the control unit 40 unifies sheet types each containing a smaller number of pages to reconstruct divisions when the number of the divided sheet types is larger than the number of the sheet carrying device or devices 4.

In this structure, division of pages is appropriately made in accordance with the device structure of the image forming system 1.

According to this embodiment, the control unit 40 allows printing for the sheet types in the ascending order of the number of pages contained in each of the sheet types, stores the sheet type or types in the sheet carrying device or devices 4, and draws the sheets P stored in the sheet carrying device or devices 4 in accordance with printing for the final sheet type to arrange the respective sheets P in the page order at the time of discharge.

In this structure, printing is performed earlier for the sheet type containing a smaller number of pages. In this case, productivity improves in comparison with printing performed earlier for the sheet type containing a larger number of pages.

According to this embodiment, the control unit 40 reverses the page order for the sheet types for which printing is performed earlier, and allows printing in the page order for the sheet type for which printing is finally performed.

In this structure, final printings arranged in the page order are appropriately produced by the use of the image forming system 1.

According to this embodiment, the sheet types are unified based on the number of pages at the time of reconstruction of the sheet type groups. However, the respective sheets P of the page configuration requiring close fixing temperatures as the division condition may be unified.

Second Embodiment

Described hereinafter is output operation performed by the image forming system 1 for outputting the sheet P according to a second embodiment. In the following description, different points between this embodiment and the first embodiment are chiefly touched upon, and the configuration similar to the corresponding configuration of the first embodiment is not repeatedly explained herein.

According to the foregoing embodiment, printing is performed earlier for a sheet type containing a smaller number of pages to reduce lowering of productivity of the image forming apparatus 3 caused by insertion of sheets. However, this situation is not necessarily applicable to all types of a page configuration of a job. This embodiment therefore focuses on realization of secure improvement of productivity of the overall system based on consideration of a page configuration.

Figure 5:
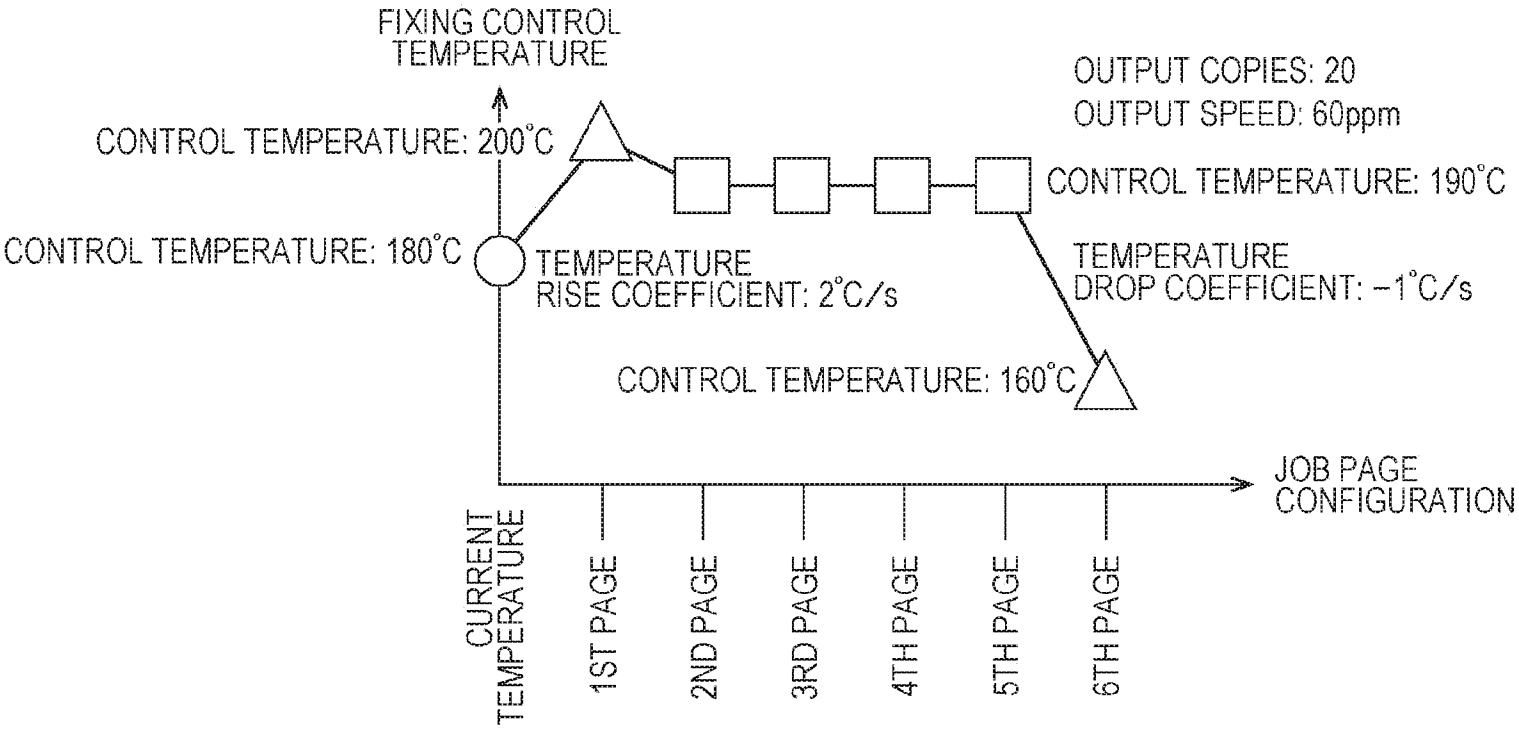
FIG. 5 is an explanatory view illustrating a determination method for determining a printing order of sheet type groups.

FIG. 5 is an explanatory view illustrating a determination method of a printing order of sheet types. The printing order of sheets is hereinafter discussed with reference to a specific example. It is assumed herein that the image forming system 1 is constituted by the image forming apparatus 3, and the one sheet carrying device 4. An output speed of the image forming apparatus 3 is set to 60 ppm.

A job is constituted by output of 20 copies of printings containing six pages in total for each copy. A current fixing control temperature is 180° C. The 1 page Pa is grouped into a sheet type corresponding to a fixing control temperature of 200° C. The 2 through 5 pages Pa are grouped into a sheet type corresponding to a fixing control temperature of 190° C. The 6 page Pa is grouped into a sheet type corresponding to a fixing control temperature of 160° C. The gradient of a temperature rise of the fixing control temperature is 2° C. per second, while the gradient of a temperature drop of the fixing control temperature is −1° C. per second.

Initially, the control unit 40 refers to a page configuration of the job, and divides respective pages constituting the job into sheet types based on a division condition. According to this embodiment, respective sheets are divided into three sheet types (sheet type groups) of a sheet type containing the 1 page Pa, a sheet type containing the 2 through 5 page Pa, and a sheet type containing the 6 age Pa. According to this example, only the one sheet carrying device 4 is provided. In this case, the number of divisions is larger than the sum of 1 and the number of the sheet carrying device 4. Accordingly, the control unit 40 adds the page configuration of the job to the division condition to reconstruct the sheet type groups.

Figure 6:
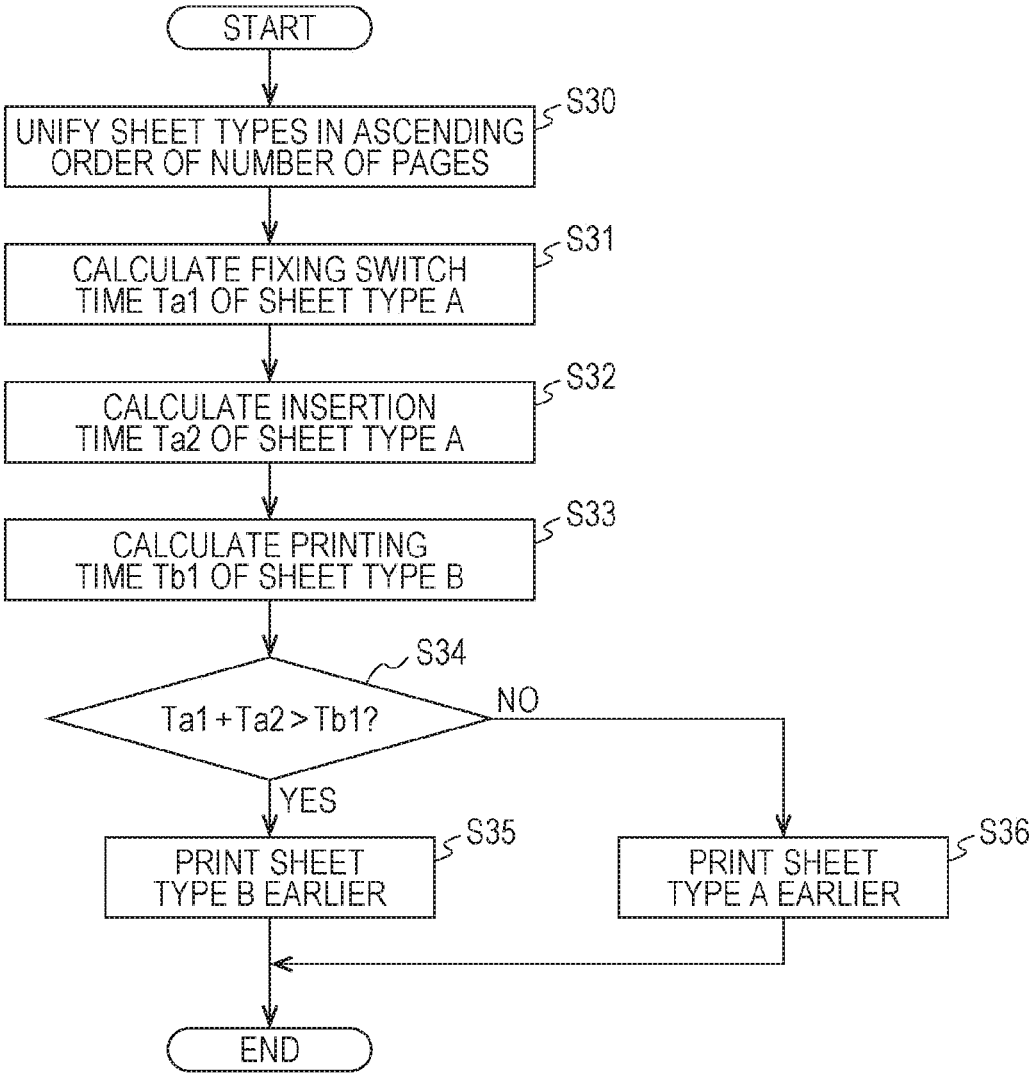
FIG. 6 is a flowchart illustrating a determination method of a printing order of sheet type groups reflecting reconstruction of the sheet type groups.

FIG. 6 is a flowchart illustrating the determination method of the printing order of the sheet types reflecting the reconstruction of the sheet type groups. The process illustrated in this flowchart is executed by the control unit 40.

In step 30 (S30), the control unit 40 initially adds the page configuration (number of pages) to the division condition to reconstruct the sheet type groups. More specifically, the control unit 40 unifies the sheet types in the ascending order of the number of pages. This step produces the new sheet type A unifying the sheet type containing the 1 page Pa and the sheet type containing the 6 page Pa. Accordingly, the pages are divided into the new sheet type A, and the sheet type B containing the remaining 2 through 5 pages Pa.

In step 31 (S31), the control unit 40 calculates a fixing switch time Ta1 of the sheet type A. The fixing switch time Ta1 is a time required for switching of the fixing control temperature at the time of printing for the sheet type A containing the 1 page Pa and the 6 page Pa by the image forming apparatus 3. Switching from the 1 page Pa to the 6 page Pa is calculated as (160−200)/(−1)=40 (sec). On the other hand, switching from the 6 page Pa to the 1 page Pa is calculated as (200−160)/(2)=20 (sec). Based on these calculations, the control unit 40 determines the fixing switch time Ta1 of the sheet type A as 40 (sec) based on the longer time of the calculated values.

In step 32 (S32), the control unit 40 calculates an insertion time Ta2 of the sheet type A. The insertion time Ta2 is a time required for insertion of the sheets P of the sheet type A from the sheet carrying device 4. The number of pages of the sheet type A is two, while the output speed of the image forming apparatus 3 is 60 ppm. Accordingly, the insertion time Ta2 of the sheet type A is calculated as 2×(60/60)=2 (sec).

In step 33 (S33), the control unit 40 calculates a printing time Tb1 of the sheet type B. The number of pages of the sheet type B is four, while the output speed of the image forming apparatus 3 is 60 ppm. Accordingly, the printing time Tb1 of the sheet type B is calculated as 4×(60/60)=4 (sec).

In step 34 (S34), the control unit 40 determines whether the sum of the fixing switch time Ta1 of the sheet type A and the insertion time Ta2 of the sheet type A is longer than the printing time Tb1 of the sheet type B (Ta1+Ta2>Tb1). When the sum of the fixing switch time Ta1 of the sheet type A and the insertion time Ta2 of the sheet type A is longer than the printing time Tb1 of the sheet type B, the flow proceeds to step 35 (S35) based on "Yes" in step 34. When the sum of the fixing switch time Ta1 of the sheet type A and the insertion time Ta2 of the sheet type A is equal to or shorter than the printing time Tb1 of the sheet type B, the flow proceeds to step 36 (S36) based on "No" in step 34.

In step 35, the control unit 40 selects the sheet type B as the earlier printed sheet type based on the fact that the job total printing time increases when the sheet type A is selected.

In step 36, the control unit 40 selects the sheet type A as the earlier printed sheet type based on the fact that the job total printing time decreases when the sheet type A is selected.

According to this embodiment discussed above, the control unit 40 determines the printing order of the sheet type A and the sheet type B while comparing the sum of the sheet insertion time for insertion of the sheet A by the sheet carrying device 4 and the fixing control temperature switching time required by the image forming apparatus 3, with the printing time for printing of the sheet type B by the image forming apparatus 3.

According to this structure, the printing order of the respective sheet types and the sheet types to be stored in the sheet carrying device 4 are appropriately determined such that the job total time decreases. Accordingly, production of final printings arranged in the page order is realizable with high work efficiency and productivity.

It is needless to mention that the present invention is not limited to the respective examples of the image forming apparatus according to the embodiments described herein. Various modifications and changes may be made without departing from the scope of the present invention. For example, the number of sheet carrying devices and a page configuration of a job may be arbitrarily determined.

Although the present invention has been described and illustrated in detail, it is clearly understood that the same is by way of illustrated and example only and is not to be taken byway of limitation, the scope of the present invention being interpreted by terms of the appended claims.

What is claimed is:

1. An image forming system comprising:

an image forming apparatus that forms an image on a sheet;

one or more sheet carrying devices successively disposed on the downstream side of the image forming apparatus; and a control device that controls the image forming apparatus and the one or more sheet carrying devices based on a single job that designates a page configuration containing a page order and sheet types of respective pages in the single job, wherein each of the sheet carrying devices includes a bypass conveyance path along which the sheet output from an upstream device is conveyed toward a downstream device, and a sheet tray unit that temporarily stores the sheet output from the upstream device and discharges the stored sheet toward the bypass conveyance path, and the control device divides the single job into sheet types based on a division condition determined beforehand, and the number of the sheet carrying device or devices disposed on the downstream side of the image forming apparatus, and determines a printing order of the divided sheet types, sheet type or types to be stored temporarily in one or more of the sheet tray units of the one or more sheet carrying devices, sheet type or types not to be stored temporarily in one or more of the sheet tray units in the one or more sheet carrying devices.

2. The image forming system according to claim 1, wherein the division condition is a fixing control temperature for fixing a transferred image to the sheet by the image forming apparatus.

3. The image forming system according to claim 2, wherein the division condition further includes the page configuration of the job.

4. The image forming system according to claim 3, wherein the control device determines a number of pages of each of the sheet types and unifies at least two of the sheet types containing the smallest number of pages to reconstruct divisions when the number of the divided sheet types is larger than the number of the sheet carrying device or devices.

5. The image forming system according to claim 2, wherein the control device determines a difference in fixing control temperatures of each of the sheet types and unifies at least two of the sheet types of sheets having the smallest difference in fixing control temperatures to reconstruct divisions when the number of the divided sheet types is larger than the number of the sheet carrying device or devices.

6. The image forming system according to claim 1, wherein the control device allows printing for the sheet types in the ascending order of the number of pages contained in each of the sheet types, stores the sheet type or types in the sheet carrying device or devices, and draws the sheets stored in the sheet carrying device or devices in accordance with printing for the final sheet type to arrange the respective sheets in the page order at the time of discharge.

7. The image forming system according to claim 1, wherein the control device reverses the page order for the sheet types for which printing is performed earlier, and allows printing in the page order for the sheet type for which printing is finally performed.

8. The image forming system according to claim 1, wherein the control device compares the sum of a sheet insertion time of the sheet carrying device associated with one sheet type and a fixing control temperature switch time of the image forming apparatus associated with the one sheet type, with a printing time of the image forming apparatus associated with a different sheet type to determine a printing order of the one sheet type and the different sheet type.

9. The image forming system according to claim 1, wherein the control device draws the stored sheets from the sheet tray unit in accordance with the printing of the sheets of the sheet type or types not to be stored temporarily in the sheet tray unit, and discharges the sheets such that the sheets are arranged in the page order.

10. The image forming system according to claim 1, wherein the control device adjusts the output intervals of the sheets such that the sheets are arranged in the page order in the single job.

11. The image forming system according to claim 1, wherein the each of the sheet carrying devices further includes a sheet discharge unit that discharges a sheet from the each of the sheet carrying devices separate from the bypass conveyance path.

12. An image forming system comprising:

an image forming apparatus that forms an image on a sheet;

one or more sheet carrying devices successively disposed on the downstream side of the image forming apparatus; and a control device that controls the image forming apparatus and the one or more sheet carrying devices based on a job that designates a page configuration containing a page order sheet types of respective pages, wherein each of the sheet carrying devices includes a bypass conveyance path along which the sheet output from an upstream device is conveyed toward a downstream device, and a sheet tray unit that temporarily stores the sheet output from the upstream device and discharges the stored sheet toward the bypass conveyance path, and the control device divides the job into sheet types based on a division condition determined beforehand, and the number of the sheet carrying device or devices disposed on the downstream side of the image forming apparatus, and determines a printing order of the divided sheet types sheet type or types to be stored in the sheet carrying device or devices, wherein the division condition includes a fixing control temperature for fixing a transferred image to the sheet by the image forming apparatus and the page configuration of the job, and wherein the control device determines a number of pages of each of the sheet types and unifies at least two of the sheet types containing the smallest number of pages to reconstruct divisions when the number of the divided sheet types is larger than the number of the sheet carrying device or devices.

13. An image forming system comprising:

an image forming apparatus that forms an image on a sheet;

one or more sheet carrying devices successively disposed on the downstream side of the image forming apparatus; and a control device that controls the image forming apparatus and the one or more sheet carrying devices based on a job that designates a page configuration containing a page order sheet types of respective pages, wherein each of the sheet carrying devices includes a bypass conveyance path along which the sheet output from an upstream device is conveyed toward a downstream device, and a sheet tray unit that temporarily stores the sheet output from the upstream device and discharges the stored sheet toward the bypass conveyance path, and the control device divides the job into sheet types based on a division condition determined beforehand, and the number of the sheet carrying device or devices disposed on the downstream side of the image forming apparatus, and determines a printing order of the divided sheet types sheet type or types to be stored in the sheet carrying device or devices, wherein the control device allows printing for the sheet types in the ascending order of the number of pages contained in each of the sheet types, stores the sheet type or types in the sheet carrying device or devices, and draws the sheets stored in the sheet carrying device or devices in accordance with printing for the final sheet type to arrange the respective sheets in the page order at the time of discharge.

* * * * *